US005799426A

United States Patent [19]

Peterson

[11] Patent Number: 5,799,426

[45] Date of Patent: Sep. 1, 1998

[54] UNIFORM THICKNESS ADHESIVE CLOSURE IDENTIFICATION BRACELET FORMED FROM RELATIVELY PERMANENTLY BONDED LAMINATES, AND RELATED METHOD OF IDENTIFICATION

[75] Inventor: Dean D. Peterson, Canoga Park, Calif.

[73] Assignee: Precision Dynamics Corporation, San Fernando, Calif.

[21] Appl. No.: 187,838

[22] Filed: Jan. 28, 1994

[51] Int. Cl.[6] ..... A44C 5/00

[52] U.S. Cl. ..... 40/633; 24/304

[58] Field of Search ..... 40/633, 630, 625, 40/304, 316, 6; 156/277; 24/304; 283/900, 74, 75, 81

[56] References Cited

U.S. PATENT DOCUMENTS

| | | | |
|---|---|---|---|
| 2,914,166 | 11/1959 | Bihler | 40/316 X |
| 4,314,415 | 2/1982 | DeWoskin | 40/633 |
| 4,526,405 | 7/1985 | Hattemer | 40/630 X |
| 4,894,106 | 1/1990 | Instance | 156/277 X |
| 4,916,841 | 4/1990 | Dawson | 40/6 X |

FOREIGN PATENT DOCUMENTS

| | | | |
|---|---|---|---|
| 552656 | 7/1993 | European Pat. Off. | 40/625 |

*Primary Examiner*—Joanne Silbermann
*Attorney, Agent, or Firm*—Thomas P. Mahoney

[57] ABSTRACT

An identification bracelet includes an integral adhesive closure which permits the bracelet to be formed in a virtually uniform thickness. The bracelet is formed of laminates that are relatively permanently bonded to each other over a majority of the body of the bracelet, with a movable cover portion formed as part of one or more of the laminates. The cover portion is adapted to be moved from a covering relationship to a non-covering relationship with respect to an adhesive disposed between two or more of the laminates. The cover may be removable from the bracelet, and may be configured with gripping portions to permit ready manipulation of the cover from the aforesaid covering relationship to the non-covering relationship. A plurality of such bracelets may be provided in a flexible strip, and a method of use of such a strip includes dispensing the strip through a printer or similar indicia-producing device and detaching each encoded bracelet from the strip and affixing same to a person or object corresponding to the encoded information.

18 Claims, 4 Drawing Sheets

UNIFORM THICKNESS ADHESIVE CLOSURE IDENTIFICATION BRACELET FORMED FROM RELATIVELY PERMANENTLY BONDED LAMINATES, AND RELATED METHOD OF IDENTIFICATION

BACKGROUND OF THE INVENTION

This invention relates to identification bracelets for identifying persons and/or objects, and specifically to an improved, durable bracelet that may be readily customized just before applying the bracelet to the person or object.

The use of identification bracelets is substantial, both in traditional areas such as hospital patient admissions and in relatively new applications such as crowd control and patron identification. In addition to being suitably attachable to the person or object to be identified, one of the main requirements of such bracelets is that they must carry appropriate and/or desired information relevant to the person or object to whom the bracelet is attached. Many varieties of bracelets presently meet these two broad criteria.

With respect to the appropriate and/or desired information carried on the bracelets, computerization and related printing technology can be utilized to print such information directly onto the bracelets. See, for example, copending and commonly assigned U.S. Ser. Nos. 07/866,325 and 07/973,269. This provides many benefits, such as eliminating the expense and risk of error associated with multiple entries of the same information, permitting improved accuracy and speed of tracking of various data, etc.

Computerized printing technology can even be used to print the information on the bracelets on demand as described, for example, in the aforementioned U.S. Ser. No. 07/973,269. Among other things, this can help eliminate waste and/or the need for maintaining large inventories of materials, and can therefore reduce costs.

Various closures are utilized to operatively affix such bracelets to the person or object to be identified. In broad terms, these closures may be described as either mechanical or adhesive. Mechanical closures typically cannot be fed through a printer, and therefore must be assembled with the bracelet subsequent to the imprinting of information on the bracelet. Among the shortcomings of mechanical closure systems are that the aforementioned downstream assembly process can sometimes be cumbersome, and inventories of the various components of the mechanical closure must typically be maintained adjacent the output side of the printer, adding to the administrative burden and time and expense necessary to utilize such systems.

Adhesive closure bracelets can eliminate many of these problems. For example, certain adhesive closure ,bracelets including the complete closure structure of the bracelets, can be fed through printers. For most adhesive closure bracelets, especially those fabricated from relatively tough, durable plastic materials, however, the structure of the closures themselves can affect the ability of the printer to accurately inscribe information, especially adjacent the closure itself. In other words, the additional layers or laminates of materials that are typically utilized to fabricate the closure portion of adhesive closure bracelets, such as removable cover strips that are eventually removed to expose the adhesive prior to attaching the bracelet to a person, can affect the quality and even the feasibility of imprinting information near the closure.

Among other things, many printers are unable to reliably and repeatably adjust to accommodate the varying thicknesses of a typical adhesive closure bracelet as it feeds through the printer. This imposes additional requirements for precise control of the articulation of the bracelets through the printer, and limits the functionality of the bracelets to some degree. In some applications, for example, it can be useful to imprint information across the closure area of the bracelet; the aforementioned limitation precludes such imprinting.

One previous solution has been to fabricate the bracelet from paper. This type of bracelet typically includes a primary paper layer that is coated on its underside with a layer of adhesive. The adhesive is covered by a layer of removable, coated backing paper. In this construction, the backing paper is the same width and length as the bracelet itself in order to cover all of the adhesive on the bracelet and prevent it from adhering to the patient or object being identified. The backing paper also typically includes a moveable and/or removable cover portion, which can be moved to expose a corresponding underlying area of the adhesive. The exposed area of adhesive is then pressed against the other end of the bracelet after the bracelet has been placed about the wrist of a patient, for example, thereby retaining the bracelet in a loop around the patient's wrist.

Although this paper bracelet construction can be readily imprinted across its entire surface, it has many shortcomings. For example, the paper itself can be relatively fragile in comparison to bracelets of vinyl plastic or similar material, and can deteriorate from exposure to water, sweat, or the like. Consequently, the bracelet can be more easily damaged and/or intentionally removed or tampered with by the wearer or otherwise, thereby affecting its reliability as an identification device. Perhaps most notably, however, the adhesive on such "paper" bracelets remains soft between the backing paper and the primary paper layer, across the entire area of the bracelet.

In other words, none of the backing paper is bonded to the primary paper layer of the bracelet. While this lack of bonding is necessary at the locus of the cover portion to permit that portion to be moved to expose the underlying area of adhesive, it can cause problems with respect to the remaining non-cover-portion of the backing paper layer. For example, any or all of the remaining backing paper layer may be inadvertently removed while applying the bracelet to a person. The remaining portions of the backing layer may even be intentionally and/or surreptitiously removed subsequent to its proper application, such as by the patient or other wearer such as a child or event-attendee fiddling with the bracelet. Even without removal of the non-cover portion of the backing paper, the adhesive can become soft especially, for example, when the bracelet has been warmed by the wearer's normal wrist temperature; in this soft condition, the adhesive can ooze from between the primary paper layer and the remaining backing paper out onto the sides of the bracelet.

Any of the foregoing situations expose the adhesive in an undesirable manner and cause the bracelet to undesirably, messily and/or uncomfortably adhere to the wearer or object to be identified.

OBJECTS AND ADVANTAGES OF THE INVENTION

It is, therefore, an object of my invention to provide an improved identification bracelet which can be utilized in on-demand "on-site" printing. In its preferred embodiment, the bracelet has a body portion formed from a plurality of laminates that are relatively permanently bonded to each other over a majority of the body portion. The body portion has a first end and a second end, and the bracelet includes adhesive closure means for attaching the first end to the second end in an operative relationship with a person or an object to be identified, such as about the wearer's wrist.

A further object of my invention is to provide an identification bracelet of the aforementioned character in which the adhesive closure means includes moveable cover means integrally formed from, and constituting a portion of, one or more of the laminates. The preferred adhesive closure means further includes adhesive means between the laminates, whereby the adhesive confronts the cover means prior to movement of the cover means. As indicated above, the cover means is moved from that confronting relationship to expose the adhesive and permit the assembly and retention of the bracelet about the wearer's wrist.

Another object of my invention is to provide an identification bracelet of the aforementioned character in which the cover means is provided with a non-adhesive coating means such as a non-bonding coating layer thereupon, so that the coating means confronts the adhesive means prior to movement of the cover means away from the adhesive means. The coating means helps insure that the cover will indeed remain moveable from the adhesive, even after the remaining portions of the laminates and adhesive have been permanently bonded together.

An additional object of my invention is to provide an identification bracelet of the aforementioned character which includes one or more scorelines in one or more of the laminates, to define the edges of the cover means. Among other things, such scorelines can improve the ease of use of the bracelet by providing ready access to the cover means. Moreover, such scorelines can help control and restrict the moveability of the cover means and prevent undesired tearing or separation of the laminates in the remainder of the laminated body portion. Such scorelines can result in the cover means being completely separable from the rest of the bracelet, or the cover means remaining attached to the bracelet even after assembly about the wearer's wrist Regarding the environmental and other reasons for such ongoing attachment, see the aforementioned U.S. Pat. No. 5,457,906 the specification of which is adopted herein by reference.

Yet another object of my invention is to provide an identification bracelet which includes an elongated laminated body portion having first and second ends, in which the laminates are relatively permanently bonded to each other over a majority of the body portion, and in which adhesive closure means is integrally formed with the body portion. The adhesive closure means preferably includes adhesive means between at least two of the laminates of the body portion and further includes a movable cover formed from one or more of the laminates capable of being moved from a covering relationship to a non-covering relationship with respect to the adhesive means.

Still another object of my invention is the provision of a multiplicity of bracelets of the aforementioned character joined together to form an elongated flexible strip. The bracelets in the strip are preferably severable one from the other along scorelines between adjacent bracelets.

An additional object of my invention is to provide an improved method to customize adhesive closure bracelets, including the steps of providing an elongated flexible strip of bracelets of the aforementioned character, dispensing the strip through an indicia-producing device, using the device to encode identifying information onto the bracelets, detaching each encoded bracelet from the strip, and operatively affixing the detached bracelet to a person or object corresponding to the encoded information.

Other objects and advantages of the invention will be apparent from the following specification and the accompanying drawings, which are for the purpose of illustration only.

DESCRIPTION OF PREFERRED EMBODIMENT

Figure 3:
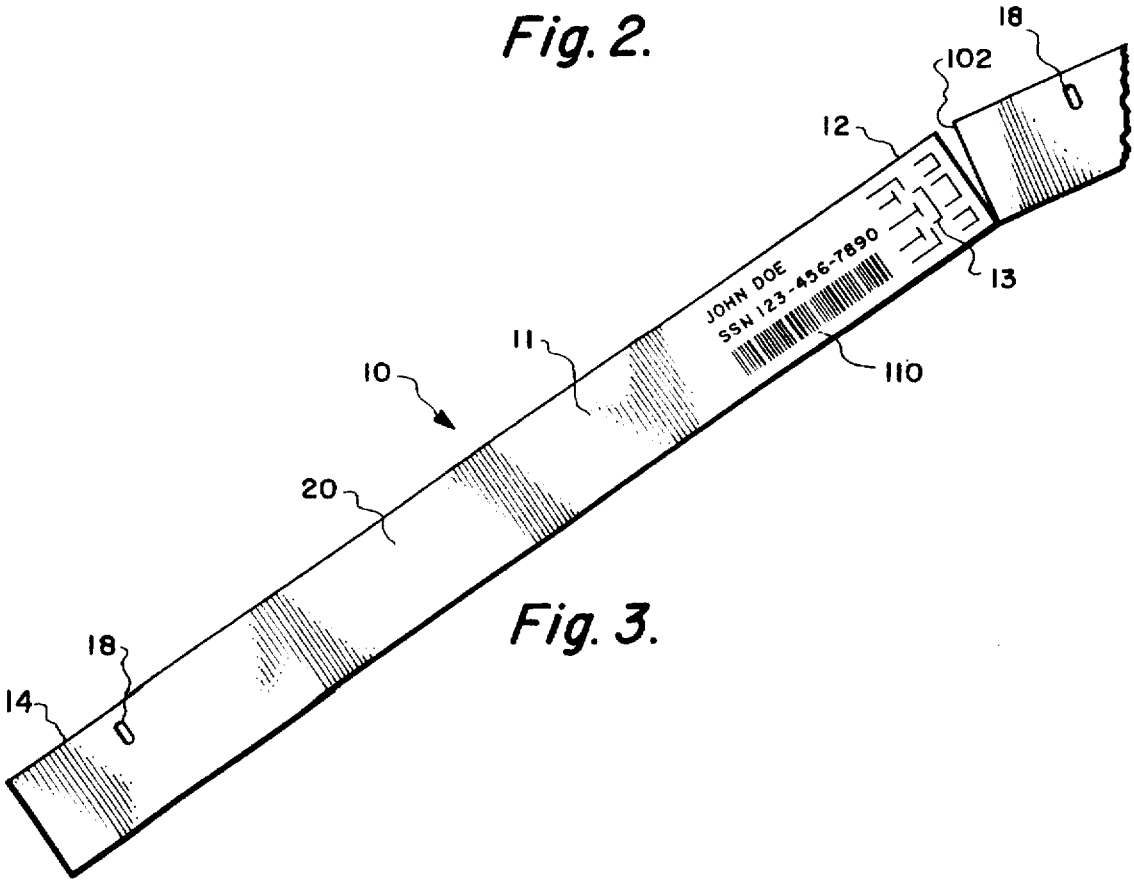
FIG. 3 is a top view of a bracelet still partially connected the aforementioned strip, taken along line 3—3 of FIG. 2.
Figure 4:
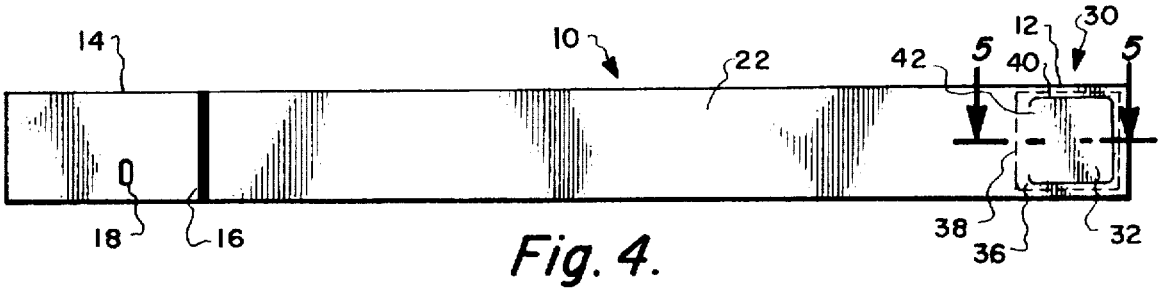
FIG. 4 is a bottom view of a bracelet fabricated in accordance with the teachings of the invention.
Figure 5:
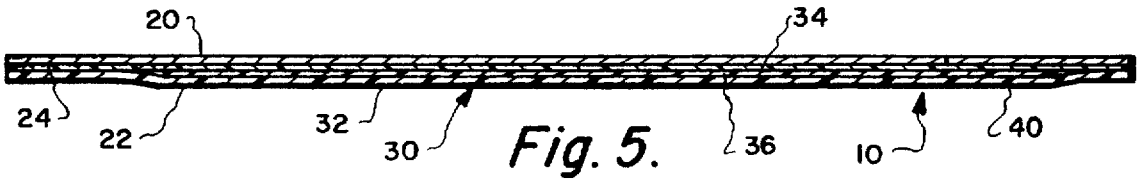
FIG.5 is a sectional view, taken along line 5—5 of FIG.

Referring to the drawings, and particularly to FIGS. 3–5 thereof, I show a preferred embodiment of an identification bracelet 10 fabricated in accordance with the teachings of the invention. The bracelet 10 includes a first end 12 and a second end 14 at the extremities of an elongated body portion 11. The bracelet is preferably manufactured from a plurality of suitably strong, lightweight, flexible laminates such as plastic, polyethylene, polypropylene, or the like, through any of a variety of appropriate laminating processes. At least one surface of the finished laminated bracelet 10 is preferably capable of receiving and maintaining identifying information such as a patient's name, as more fully described below.

The embodiment of FIGS. 3–5 illustrates a bracelet 10 comprised of a first laminate 20, FIG. 5, and a second laminate 22, relatively permanently bonded to each other by adhesive means such as an adhesive layer 24. Those skilled in the art will understand, however, that a wide variety of numbers of layers of laminates and bonding mechanisms may be utilized without departing from the scope of my invention.

The lamination of the bracelet 10 results in a band of relatively uniform thickness across its entire surface. This renders it particularly useful in connection with on-demand, on-site imprinting of identifying information.

Figure 1:
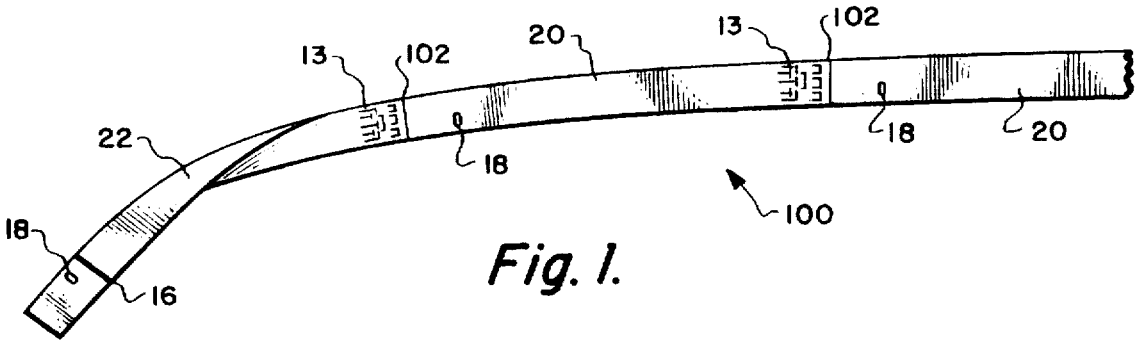
FIG. 1 is a perspective view of a preferred embodiment of a strip of bracelets constructed in accordance with the teachings of the invention.
Figure 2:
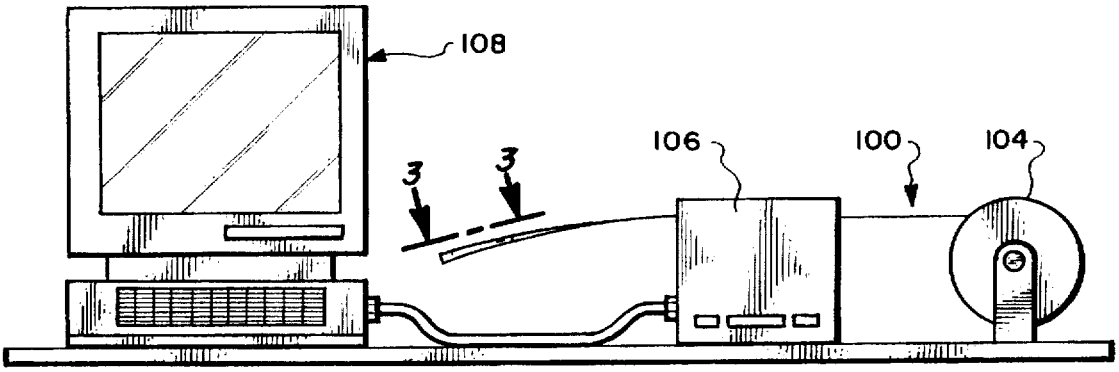
FIG. 2 is an elevational view showing a strip such as shown in FIG. 1 as it might be used in a system and method of identifying persons at a hospital, theater, concert, or similar event.

In that regard, a preferred method of using the bracelets 10 is illustrated in FIGS. 1–3, wherein a plurality of bracelets 10 is provided in the form of a strip 100, FIGS. 1–2 by forming the bracelets in abutting, end-to-end configuration. The bracelets 10 are defined one from the other in the strip 100 by scorelines 102 in the laminates, which scorelines are suitably deep to enable the ready separation of the bracelets each from the other but not so deep as to make premature and undesirable separation likely. For economy of manufacture, a multiplicity (not shown) of such strips 100 may be simultaneously formed side-by-side prior to being slit into individual strips such as the strip 100.

The strip 100 may be conveniently stored and transported on a spool member such as spool 104, FIG. 2, and eventually dispensed through a printer 106 operated by a computer 108. The computer and printer are preferably capable of imprinting desired identifying information 110, FIG. 3, onto each bracelet 10 as the bracelet passes through the printer 106. By way of example but not by way of limitation, in the exemplary bracelet of FIG. 3, the printer 106 has imprinted the name, Social Security Number, and barcoded information corresponding to the person who will be wearing the bracelet. If such a system were in use at a hospital admissions desk, for example, the patient's information would only have to be entered one time; for all subsequent visits to the hospital, the admissions nurse could utilize the previously-entered information without having to re-enter it.

In order to position the identifying information 110 at the desired location along the length of the bracelet 10, each bracelet is preferably provided with both a reflective sensor strip 16 and a through-light sensor hole 18. Those skilled in the art will understand that sensors in the printer 106 can utilize the sensors 16 and/or 18 to precisely control the feed of the strip 100 through the printer 106 and thereby ensure that the identifying information 110 is printed at the desired location along the length of the bracelet 10. In the embodiment of FIG. 3, the information is located near the first end 12 of the bracelet 10, to reduce the likelihood that the information 110 will be inadvertently covered up by the adhesion of the ends of the bracelet to one another, which will now be described.

The preferred embodiment of the bracelet 10 includes adhesive closure means 30 for attaching the first end 12 to the second end 14 in an operative relationship with a person or an object to be identified. The preferred adhesive closure means 30 includes moveable cover means 32 integrally formed from, and constituting a portion of, the second laminate 22. Persons of ordinary skill in the art will understand that, where more than two laminates are used to form the bracelet 10, the cover means 32 may be formed from one or more of the laminates, so long as it does not include the first laminate 20.

The adhesive closure means 30 further includes adhesive means 34 between the laminates and confronting the cover means. In the preferred embodiment, the adhesive means 34 constitutes that portion of the adhesive 24 that extends across the body portion 11 of the bracelet 10, but in certain embodiments, the adhesive 34 may be a different and/or additional adhesive material than that used in the body portion 11.

In the preferred bracelet 10, the cover means 32 includes non-adhesive coating means 36 such as a layer of silicone or other non-bonding coating layer. The coating means 36 confronts the adhesive means 34 and helps ensure that the cover means 32 will not adhere to the underlying adhesive means 34, so that the closure means 30 can be utilized as more fully described below. Those skilled in the art will understand that the requisite thickness of silicone is exaggerated in FIG. 5 for purposes of illustration, and that the actual thickness is preferably negligible so as not to negatively affect the imprinting of information on the bracelet, as described above.

The preferred boundaries of the non-adhesive coating means 36 are indicated by the dash line 38 in FIG. 4. Other than this small area of silicone coating, the bracelet preferably is fabricated of virtually uniform thickness, permitting the printer 106 to reliably and readably imprint the information 110 anywhere on the surface of the bracelet 10.

Figure 6:
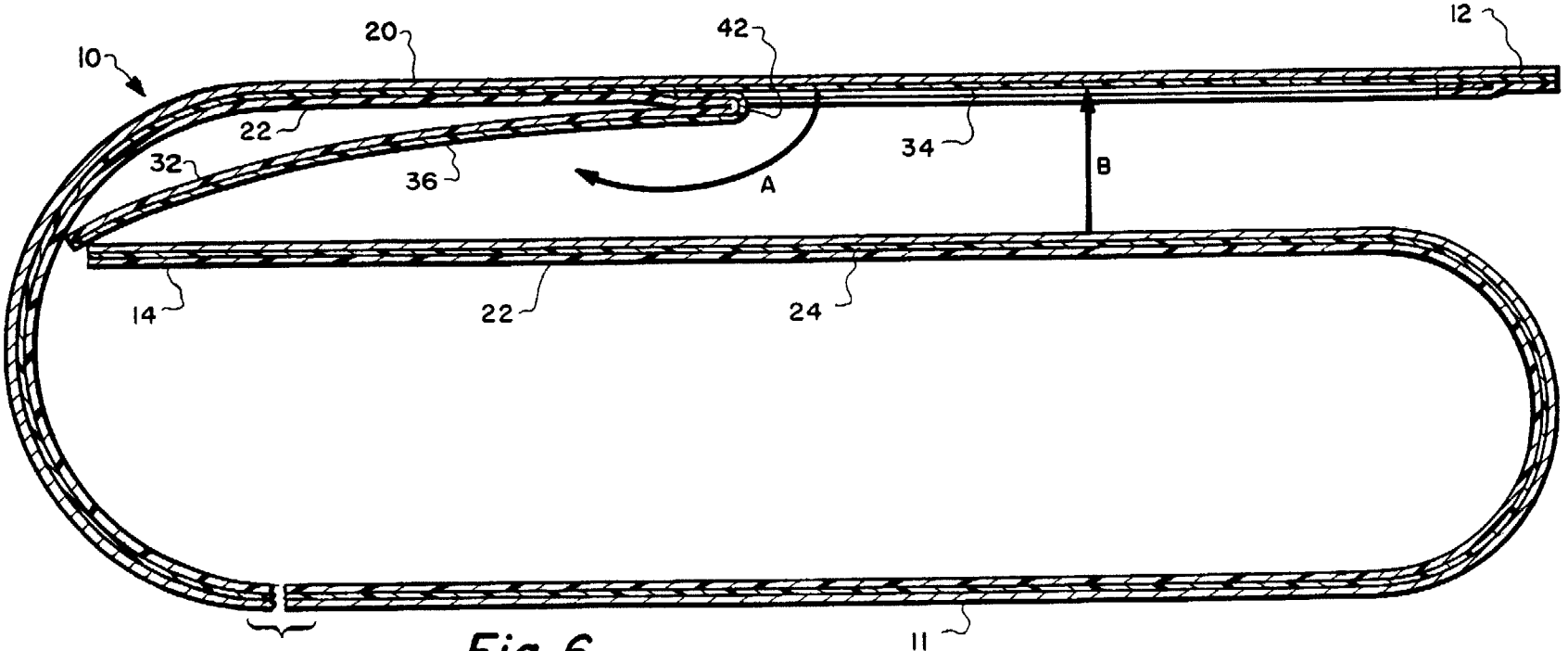
FIG. 6 is a broken sectional view illustrating the exposure of the adhesive means and subsequent joinder of the two ends of the bracelet.
Figure 7:
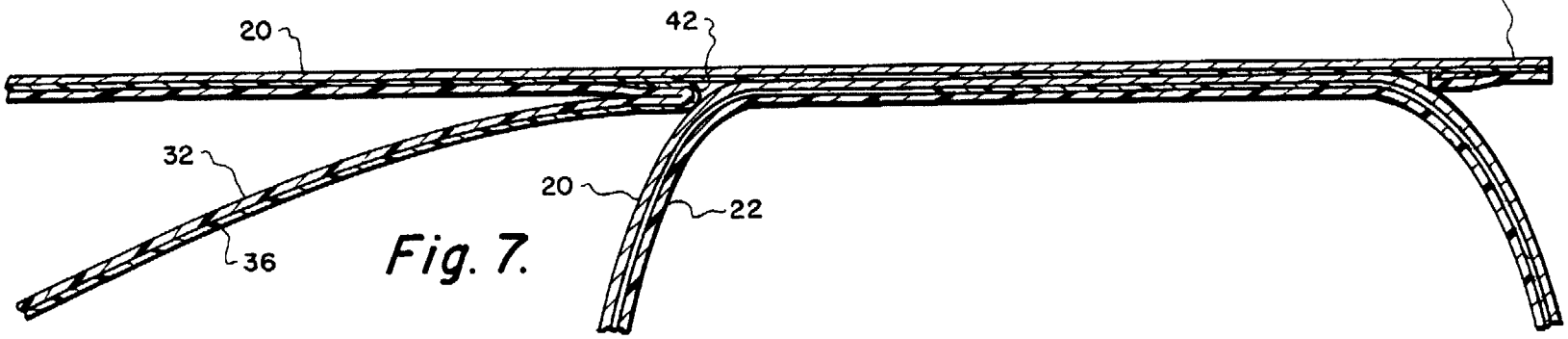
FIG. 7 is a partial sectional view illustrating the two ends of the bracelet adhesively joined to each other.

In the preferred embodiment 10, edges of the cover means 32 are defined by one or more scorelines 40 in the second laminate 22 or in the plurality of laminates, if more than two laminates are used in the bracelet and more than one laminate is used in the cover means. As best shown in FIGS. 6 and 7, the scorelines 40 permit the cover means 32 to be pulled away from the adhesive means 34 as indicated by arrow A, exposing the adhesive 34 so that the second end 14 of the bracelet 10 can be adhered thereto (as indicated by arrow B).

Figure 8:
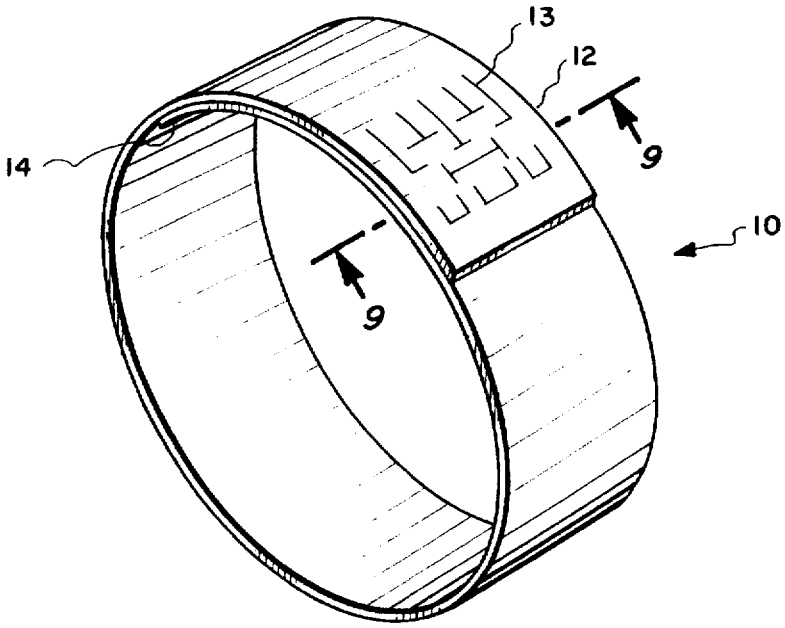
FIG. 8 is a perspective view illustrating a bracelet of the invention with its two ends adhesively joined to each other.
Figure 9:
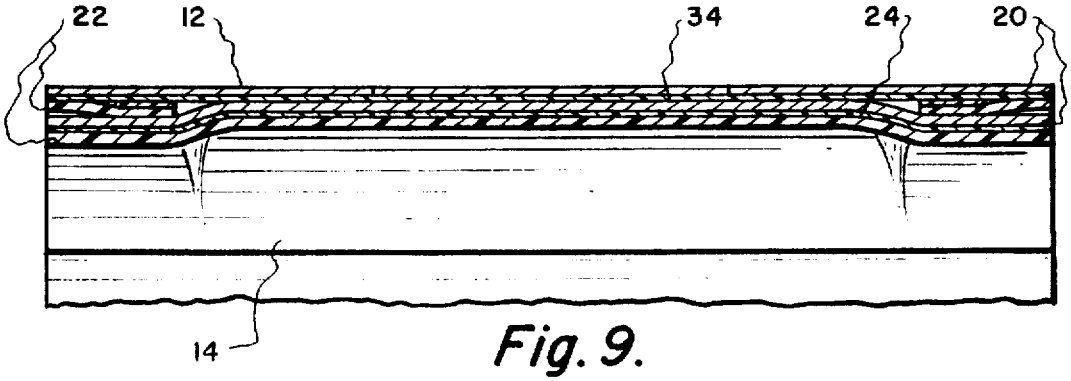
FIG. 9 a sectional view, taken along line 9—9 of FIG. 8.

The adhered, assembled bracelet is illustrated in FIGS. 7–9. Persons of ordinary skill in the art will understand that, prior to pressing the second end 14 against the adhesive means 34 and thereby fixing the bracelet into a loop, the person applying the bracelet will appropriately adjust the circumference of the loop by moving the ends 12 and 14 longitudinally with respect to each other.

When applied to patients in a hospital, for example, the admissions nurse will cause the printer to print the patient's identifying information on the bracelet 10, and will then affix the bracelet into a comfortably-sized loop about the patient's wrist or ankle. The size of the loop will normally be larger than the ankle or wrist so as to avoid discomfort to the wearer, but small enough to preclude inadvertent removal of the bracelet such as by slipping it over the wearer's hand or foot.

Where desired, the cover means 32 can remain connected to the one or more of the laminates 22 from which it is formed. This eliminates any litter to be disposed of at the time the bracelet 10 is applied to the wearer. In the preferred embodiment, this connection is achieved by the provision of connecting means 42 formed by an interruption in the scorelines 40. In alternative embodiments FIG. 13, the cover means 32 may be removable or separable from the one or more of the bracelet laminates. Persons of ordinary skill in the art will understand that this is accomplished by appropriate arrangements of scorelines such as scorelines 40.

To provide tamper evidence (especially useful, for example, when the bracelets are used for identifying patrons at concerts, theme parks or the like), a pattern of lacerations 13 may be provided in the first laminate 20 adjacent the adhesive means 34. After the bracelet 10 has been assembled on a wearer's wrist, any attempt to detach the bracelet and reattach it to another person will be likely to damage the lacerated area 13, or will at least be more likely to cause some visible damage thereto than might not be visible if no lacerations were provided. Officials at the hospital or concert, etc., can then attempt to monitor any such unauthorized transfers of the bracelets from one person to another.

The adhesive closure means 30 can be provided in a wide range of sizes, orientations, and configurations. Examples of alternative embodiments of the adhesive closure means 30 are illustrated in FIGS. 10–16, all of which permit perhaps easier manipulation of the cover means to expose the underlying adhesive.

Figure 10:
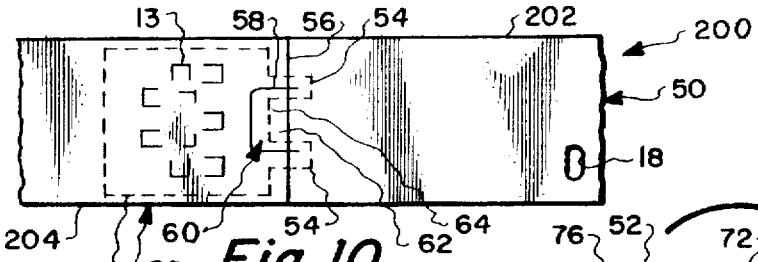
FIG. 10 is a partial top view of an alternative embodiment of a strip of bracelets constructed in accordance with the teachings of the invention, illustrating an alternative cover means and corresponding joint between adjacent bracelets in the strip.
Figure 11:
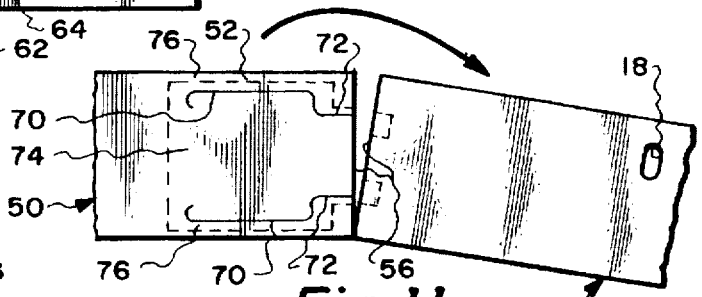
FIG. 11 is a partial bottom view of the bracelets of FIG. 10, but also illustrates the breaking or tearing of the bracelets from each other.
Figure 12:
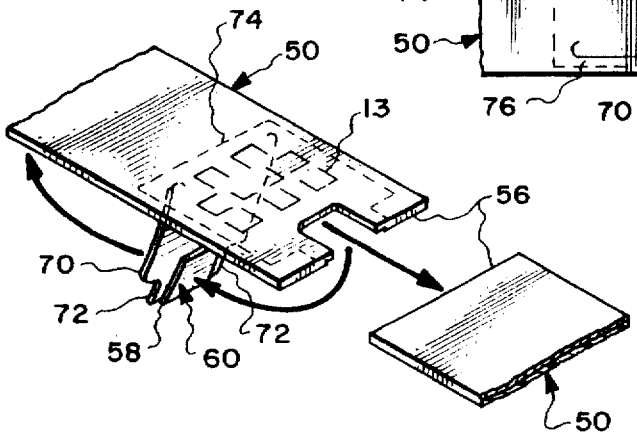
FIG. 12 is a perspective view of the bracelets of FIG. 11 following the separation of them from each other.

In the embodiment of FIGS. 10–12, the adhesive closure means includes a somewhat more complex arrangement and structure of scorelines and non-adhesive coating means than that illustrated in, for example, FIG. 4. The broad principles of operation of both embodiments remain as described above, however.

In FIG. 10, a portion of a strip 200 of bracelets 50 is illustrated, depicting the same end-to-end abutment described above. In this embodiment, however, the pattern of the non-adhesive coating means 52 is shown by a dashed line, and includes a plurality of extensions 54 that cross the end scoreline 56 between the bracelets 50. Within the area indicated by the dashed line, the laminates of the bracelet will not bond to one another, but instead remain readily separable.

The adhesive closure means of FIG. 10 further includes one or more scorelines 58 in the upper or outside laminate of the bracelets 50. In this embodiment, the scorelines 58 and 56 define a tab portion 60. The tab portion 60 includes a bonded area 62 defined by the end scoreline 56 and the border 64 of the non-adhesive coating means 52. The border 64 comprises a portion of the dashed line in FIG. 10. Persons of ordinary skill in the art will understand that the size, location, orientation and configuration of the tab portion and the bonded area can be designed in a wide variety of suitable patterns.

The underside of the identification bracelet of FIG. 10 is illustrated in FIG. 11, and includes one or more scorelines 70. Scorelines 70 are similar to the scorelines 40 of FIG. 4, but include extending portions 72 which intersect the end scoreline 56. As shown in FIGS. 11 and 12, this permits the bracelets 50 to be separated one from the other FIG. 11, and the tab portion 60 to be gripped and pulled downwardly FIG. 12 to pull the cover means away from the underlying adhesive and expose that adhesive for contact with the other end of the bracelet to form the desired functional loop. Other than the extending portions 72 and the corresponding tab portion 60, most of the following description applies with equal cogency to the closure mechanism depicted in FIG. 4.

Those skilled in the art will understand that the pattern of coating means 52 in FIG. 10, as well as different and even more complex patterns, may be provided during the lamination process by any of a variety of known processes. In the embodiment of FIGS. 10-12, the coating means 52 is provided in a sufficiently wide area underlying the scorelines 72 and 58 to ensure that the tab portion 60 will operably separate from the upper laminate rather than being bonded thereto. By providing some additional width of coating means, the manufacturing tolerances for positioning the scorelines 72 and 58 can be correspondingly increased.

Figure 13:
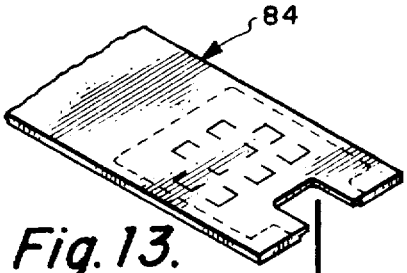
FIG. 13 is similar to FIG. 12, but shows another alternative embodiment in which the cover means is removable from the bracelet.

As illustrated in FIG. 13, the cover means 80 can easily be made removable or separable from the remainder of the bracelet 84, by extending the scoreline 82 along what would otherwise be a hinge line 74 FIGS. 11 and 12.

Thus, in the embodiments of FIGS. 10-13, the body portion of the bracelet is elongated along an axis running the length of the strip 200, and two side edges 202 and 204 are parallel to that axis of elongation and two end edges (one is along scoreline 56; the other is not shown) intersect that axis of elongation. To form the grippable tab portion 60, various scorelines 58, 70 and 72 are spaced from the side edges 202 and 204, and intersect one or more of the end edges such as along line 56.

By spacing the border of the non-adhesive means 52 from the edges 202 and 204 of the bracelet 50, and by positioning the scorelines 70 even further from those edges, the above-described releasability or non-adherence of the cover means to the upper laminate can be ensured and can be manufactured with reasonable dimensional tolerances and control. In addition, this arrangement results in outer edge laminated portions 76 that are at least partially bonded together rather than being unbonded and separable. Although these outer edge laminated portions 76 are not necessary for the operability of the bracelet (see, for example, the embodiment of FIGS. 14–16 which does not include such portions), the portions 76 provide some tolerance for side-to-side misalignment of the ends of the bracelet when they are being adhered to each other. In other words, without the portions 76, any side-to-side misalignment at the adhesive closure means would result in some part of the adhesive means being uncovered, even after adherence of the ends to each other, and therefore undesirably exposed to the wearer's skin, clothing, etc.

Figure 14:
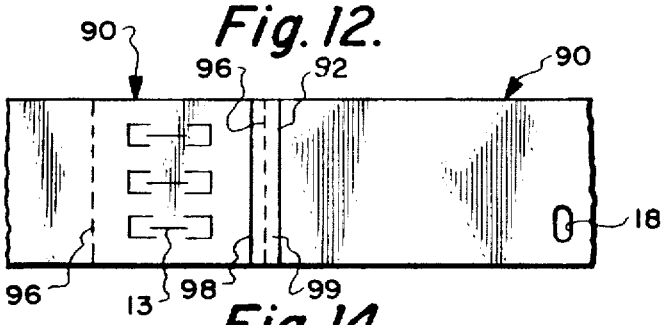
FIGS. 14–16 are similar to FIGS. 10–13, respectively, but illustrate yet another alternative embodiment of the cover means of the invention.
Figure 15:
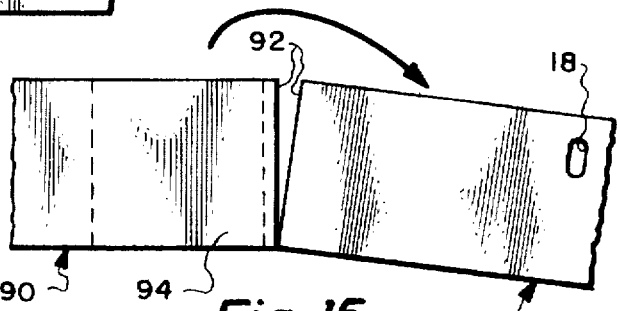
Figure 16:
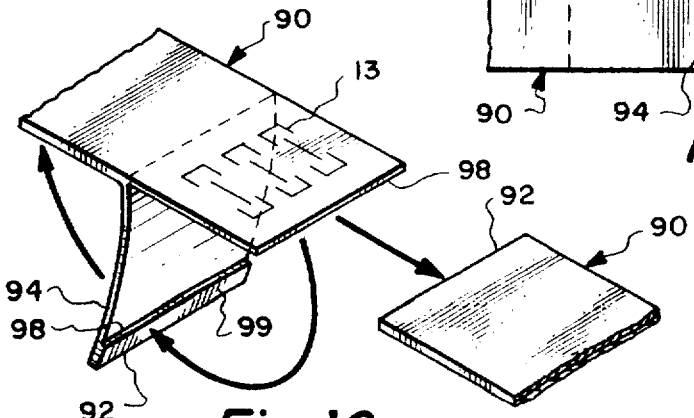

Additional exemplary alternative embodiments of the adhesive closure means include, without limitation, that illustrated in FIGS. 14–16. The bracelets 90 may be separated along a scoreline 92. The cover means 94 extends the full width of the bracelet 90, as does the non-adhesive coating between the dashed lines 96. An upper scoreline 98 is provided in the upper laminate, FIGS. 14 and 16. In the embodiment of FIGS. 14–16, the edge 96 of the non-adhesive coating is spaced from the end scoreline 92, and the upper scoreline 98 is further spaced from the end scoreline 92. This results in a gripping portion 99 that is at least partially bonded to the cover means 94, and provides the manufacturing tolerances and ease of use, all as discussed above with respect to the embodiments of FIGS. 10–13.

Those skilled in the art will understand that the configuration and design of the various scorelines in the bracelet can affect the manufacturing processes that may be used to fabricate the bracelets, and vice versa. For example, if the bracelets are provided in an elongated strip as shown in FIG. 1, the scorelines must be arranged so that the strip will not prematurely separate under the load of tensile force along the length of the strip, such as might occur during various manufacturing processes.

Thus, by my invention, I provide a simple and reliable identification bracelet and method of using same, by which any portion of the body of the bracelet may be imprinted on-site in a continuous feed process.

The identification bracelet and method of my invention has been described with some particularity but the specific designs, constructions and steps disclosed are not to be taken as delimiting of the invention in that various modifications will at once make themselves apparent to those of ordinary skill in the art, all of which will not depart from the essence of the invention and all such changes and modifications are intended to be encompassed within the appended claims.

I claim:

1. An identification bracelet having a body portion formed from a plurality of coextensive laminates that are relatively permanently bonded to each other over a majority of said body portion, said body portion having a first end and a second end; said bracelet having a substantially uniform thickness along the length thereof and including identifying indicia on at least one of said laminates; said bracelet further having adhesive closure means for attaching said first end to said second end in an operative relationship with a person or an object to be identified; said adhesive closure means including moveable cover means integrally formed from, and constituting a portion of, one or more of said laminates; said adhesive closure means further including adhesive means between said laminates confronting said cover means prior to movement of said cover means and exposable by movement of said cover means.

2. The identification bracelet of claim 1, in which said cover means includes a non-bonding coating layer, said layer confronting said adhesive means prior to movement of said cover means away from said adhesive means.

3. The identification bracelet of claim 1 or claim 2, further including one or more scorelines in said one or more of said laminates, which scorelines define one or more edges of said cover means.

4. The identification bracelet of claim 3, in which said cover means is removable from said one or more of said laminates.

5. An identification bracelet, including: an elongated laminated body portion having a first end and a second end, said laminated body portion being formed from coextensive laminates relatively permanently bonded to each other over a majority of said body portion; adhesive closure means integrally formed with said body portion, said adhesive closure means including adhesive means between at least two of said laminates of said body portion and further including a movable cover capable of being moved from a covering relationship to a non-covering relationship with respect to said adhesive means in which said cover means remains affixed to said body portion when said cover is moved to said non-covering relationship.

6. The identification bracelet of claim, 5, in which said cover means is separable from said body portion.

7. The identification bracelet of claim 5 or claim 6 in which said movable cover includes a surface which confronts said adhesive means when said cover is in said covering relationship with respect to said adhesive means, said surface further including non-adhesive coating means affixed thereto.

8. The identification bracelet of claim 5 or claim 6, in which said cover is formed by the provision of one or more scorelines in certain of said laminates.

9. A multiplicity of bracelets joined together in an elongated flexible strip, said bracelets having body portions formed from coextensive laminates permanently bonded together on at least the major areas of said laminates and being severable one from the other along scorelines between adjacent bracelets, said bracelets including adhesive closure means integrally formed with said laminates; said bracelets having a substantially uniform thickness along the length thereof and including identifying indicia on at least one of said laminates.

10. An identification bracelet formed from a plurality of laminates, said bracelet having a uniform thickness and having a first end and a second end remote therefrom; said bracelet including identifying indicia on at least one of said laminates; said bracelet including adhesive means for attaching said first end to said second end in an operative relationship with a person or an object to be identified; said bracelet including moveable cover means disposed adjacent said adhesive means, said cover means being integrally formed from, and constituting a portion of, one or more of said laminates; said laminates being relatively permanently bonded to each other except at the location of said cover means; said cover means being selectively moveable from an initial position covering said adhesive means to a subsequent position exposing said adhesive means.

11. The identification bracelet of claim 10, including a non-bonding coating layer on said cover means confronting said adhesive means prior to movement of said cover means away from said adhesive means.

12. The identification bracelet of claim 10 or claim 11, further including one or more scorelines in said one or more of said laminates, which scorelines define one or more edges of said cover means.

13. The identification bracelet of claim 12, including connecting means between said cover means and said one or more of said laminates to maintain a connection therebetween after movement of said cover means away from said adhesive means, in which said connecting means is formed by an interruption in said scorelines.

14. The identification bracelet of claim 12, in which said cover means is removable from said one or more of said laminates.

15. An identification bracelet having a body portion formed from a plurality of laminates that are relatively permanently bonded to each other over a major portion of said laminates, said portion having a first end and a second end; said bracelet further having adhesive closure means for attaching said first end to said second end in an operative relationship with a person or an object to be identified; said adhesive closure means including moveable cover means integrally formed from, and constituting a portion of, one or more of said laminates; said adhesive closure means further including adhesive means between said laminates confronting said cover means prior to movement of said cover means and exposable by movement of said cover means, further including one or more scorelines in said one or more of said laminates, which scorelines define one or more edges of said cover means, including connecting means between said cover means and said one or more of said laminates to maintain a connection therebetween after movement of said cover means away from said adhesive means, in which said connecting means is formed by an interruption in said scorelines.

16. The identification bracelet of claim 15, in which said cover means includes a non-bonding coating layer, said layer confronting said adhesive means prior to movement of said cover means away from said adhesive means.

17. An identification bracelet, including: an elongated laminated body portion having a first end and a second end, said laminated body portion being formed from laminates relatively permanently bonded to each other over a majority of said body portion; adhesive closure means integrally formed with said body portion, said adhesive closure means including adhesive means between at least two of said laminates of said body portion and further including a movable cover capable of being moved from a covering relationship to a non-covering relationship with respect to said adhesive means, in which said cover is formed by the provision of one or more scorelines in certain of said laminates, in which said body portion is elongated along an axis and includes two side edges which are parallel to said axis of elongation and two end edges which intersect said axis of elongation, and said scorelines are spaced from said side edges and intersect one or more of said end edges.

18. The identification bracelet of claim 17, in which said cover means is separable from said body portion.

* * * * *

UNITED STATES PATENT AND TRADEMARK OFFICE

CERTIFICATE OF CORRECTION

PATENT NO. : 5,799,426

DATED : September 1, 1998

INVENTOR(S) : Dean D. Peterson

It is certified that error appears in the above-identified patent and that said Letters Patent is hereby corrected as shown below:

Column 1, line 32, after "demand", insert--,--; and line 51, remove--,--before "bracelets" and insert--,--after "bracelets".

Column 2, line 46, after "wearer", insert--,--;

line 48, after "soft", insert--,--;

line 52, after "paper", remove--out--; and line 64, after "demand", remove--"on-site"--and insert, in its place,--,on-site--.

Column 3, line 38, after "wrist", insert--.--;

line 40, after "see", remove--the aforementioned--; and line 41, after "5,457,906", insert--,--.

UNITED STATES PATENT AND TRADEMARK OFFICE

CERTIFICATE OF CORRECTION

PATENT NO. : 5,799,426

DATED : September 1, 1998

INVENTOR(S) : Dean D. Peterson

It is certified that error appears in the above-identified patent and that said Letters Patent is hereby corrected as shown below:

Column 4, line 21, after "line 5-5 of FIG.", insert--4;--.

Column 6, line 21, after "22", insert--,--;

line 25, after "34", insert--,--; and line 51, after "embodiments", insert--,--.

Column 7, line 38, after "other", insert--,--;

line 39, after "downwardly", insert--,--;

line 40, after "12", insert--,--; and

UNITED STATES PATENT AND TRADEMARK OFFICE

CERTIFICATE OF CORRECTION

PATENT NO. : 5,799,426

DATED : September 1, 1998

INVENTOR(S) : Dean D. Peterson

It is certified that error appears in the above-identified patent and that said Letters Patent is hereby corrected as shown below:

line 60, after "74", insert--,--.

Signed and Sealed this

Sixteenth Day of March, 1999

*Attest:*

*Attesting Officer*

Q. TODD DICKINSON

*Acting Commissioner of Patents and Trademarks*